US010969722B2

(12) United States Patent
Sakamoto

(10) Patent No.: US 10,969,722 B2
(45) Date of Patent: Apr. 6, 2021

(54) IMAGE FORMING APPARATUS

(71) Applicant: CANON KABUSHIKI KAISHA, Tokyo (JP)

(72) Inventor: Yusuke Sakamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/919,416

(22) Filed: Jul. 2, 2020

(65) Prior Publication Data

US 2021/0011409 A1 Jan. 14, 2021

(30) Foreign Application Priority Data

Jul. 11, 2019 (JP) ..... JP2019-128951

(51) Int. Cl.
*G03G 15/00* (2006.01)
*G03G 15/20* (2006.01)

(52) U.S. Cl.
CPC ..... *G03G 15/50* (2013.01); *G03G 15/205* (2013.01); *G03G 15/2028* (2013.01)

(58) Field of Classification Search
CPC combination set(s) only.
See application file for complete search history.

(56) References Cited

U.S. PATENT DOCUMENTS

2019/0086857 A1* 3/2019 Tsuchihashi ..... G03G 15/6576

FOREIGN PATENT DOCUMENTS

| | | | |
|---|---|---|---|
| JP | 5-150675 | A | 6/1993 |
| JP | 2002-132084 | A | 5/2002 |
| JP | 2005-62359 | A | 3/2005 |
| JP | 2005-215229 | A | 8/2005 |

* cited by examiner

*Primary Examiner* — Victor Verbitsky
(74) *Attorney, Agent, or Firm* — Venable LLP

(57) ABSTRACT

A controller is configured to control a drive unit and a heating element to execute a first mode and a second mode. The first mode is a mode in which the sheet is conveyed through a predetermined conveyance section in a duplex image formation by taking a first time length. The second mode is a mode in which the sheet is conveyed through the conveyance section in the duplex image formation by taking a second time length longer than the first time length. In the second mode, the controller is configured to execute a temperature decrease processing and thereafter execute a temperature increase processing in a period in which the sheet is conveyed through the conveyance section.

13 Claims, 9 Drawing Sheets

FIG.6

| | | SHEET WIDTH W (mm) | | |
|---|---|---|---|---|
| | | W < 148 | 148≤W < 200 | 200≤W |
| SHEET LENGTH L (mm) | L< 210 | 90 | 90 | 180 |
| | 210≤L< 270 | 60 | 90 | 180 |
| | 270≤L | 60 | 60 | 180 |

UNIT mm/s

FIG.9

| | | TARGET FIXING TEMPERATURE T1 (℃) | | |
|---|---|---|---|---|
| | | T1< 140 | 140≤T1< 180 | 180≤T1 |
| TEMPERATURE DIFFERENCE BETWEEN THERMISTORS ΔT (℃) (EDGE − CENTER PORTION) | ΔT< 40 | 180 | 180 | 90 |
| | 40≤ΔT< 80 | 90 | 90 | 60 |
| | 80≤ΔT | 90 | 60 | 60 |

UNIT : mm/s

IMAGE FORMING APPARATUS

BACKGROUND OF THE INVENTION

Field of the Invention

The present invention relates to an image forming apparatus which forms an image on a sheet.

Description of the Related Art

In an image forming apparatus such as a printer, a copy machine, and a facsimile machine, a final printed matter is output by heating a toner image borne on a recording material in a fixing unit. A film heating method is one of heating mechanisms included in the fixing unit, and Japanese Patent Laid-Open No. H5-150675 discloses the heating mechanism which decreases a temperature of the fixing unit by idly operating the fixing unit with power supply to the heater being turned off after the toner image has been fixed on the recording material.

In this respect, in a case of a duplex printing, there is a possibility, depending on a processing condition of a printing, that an excessive temperature rise in which a temperature of the fixing unit is abnormally risen occurs by a printing on a front surface of the recording material. When the fixing unit has been brought into the excessive temperature rise, there is a possibility that durability of the unit is deteriorated due to degeneration or distortion of a rubber or a resin component in the unit, and degradation of a printing quality is caused by the distortion of a film which leads to variations in a feed speed of a recording material, an excessive dissolution of the toner, and a hot offset.

SUMMARY OF THE INVENTION

The present invention provides an image forming apparatus capable of preventing an excessive temperature rise of a fixing unit in performing a duplex printing.

According to one aspect of the invention, an image forming apparatus includes an image bearing member configured to bear a toner image, a transfer member configured to transfer the toner image borne on the image bearing member to a sheet, a fixing unit including a rotary member pair configured to form a nip portion and a heating element configured to generate a heat by being supplied with power to heat the nip portion, and configured to fix the toner image on the sheet by heating the toner image transferred to the sheet at the nip portion, a reverse conveyance unit configured to reverse the sheet which has passed through the nip portion, and resume to convey the sheet toward the transfer member, a drive unit configured to drive the reverse conveyance unit, and a controller configured to control the drive unit and the heating element to execute a first mode and a second mode. The first mode is a mode in which the sheet is conveyed through a predetermined conveyance section in a duplex image formation by taking a first time length. The conveyance section is a section from a point at which the sheet transferred with a first toner image on a first surface of the sheet has passed through the nip portion to a point at which the sheet passed through the nip portion arrives at the nip portion again after reversed by the reverse conveyance unit and transferred with a second toner image to a second surface of the sheet by the transfer member. The second mode is a mode in which the sheet is conveyed through the conveyance section in the duplex image formation by taking a second time length longer than the first time length. In the second mode, the controller is configured to execute a temperature decrease processing and thereafter execute a temperature increase processing in a period in which the sheet is conveyed through the conveyance section. The temperature decrease processing is a processing to change a target temperature of the heating element from a first temperature to a second temperature. The temperature increase processing is a processing to change the target temperature of the heating element from the second temperature to the first temperature. The first temperature is a temperature to fix the first and second toner images on the sheet. The second temperature is lower than the first temperature.

Further features of the present invention will become apparent from the following description of exemplary embodiments with reference to the attached drawings.

BRIEF DESCRIPTION OF THE DRAWINGS

FIG. 6 shows an example of a sheet conveyance speed in the second embodiment.

FIG. 9 shows an example of a sheet conveyance speed in the third embodiment.

DESCRIPTION OF THE EMBODIMENTS

Figure 1:
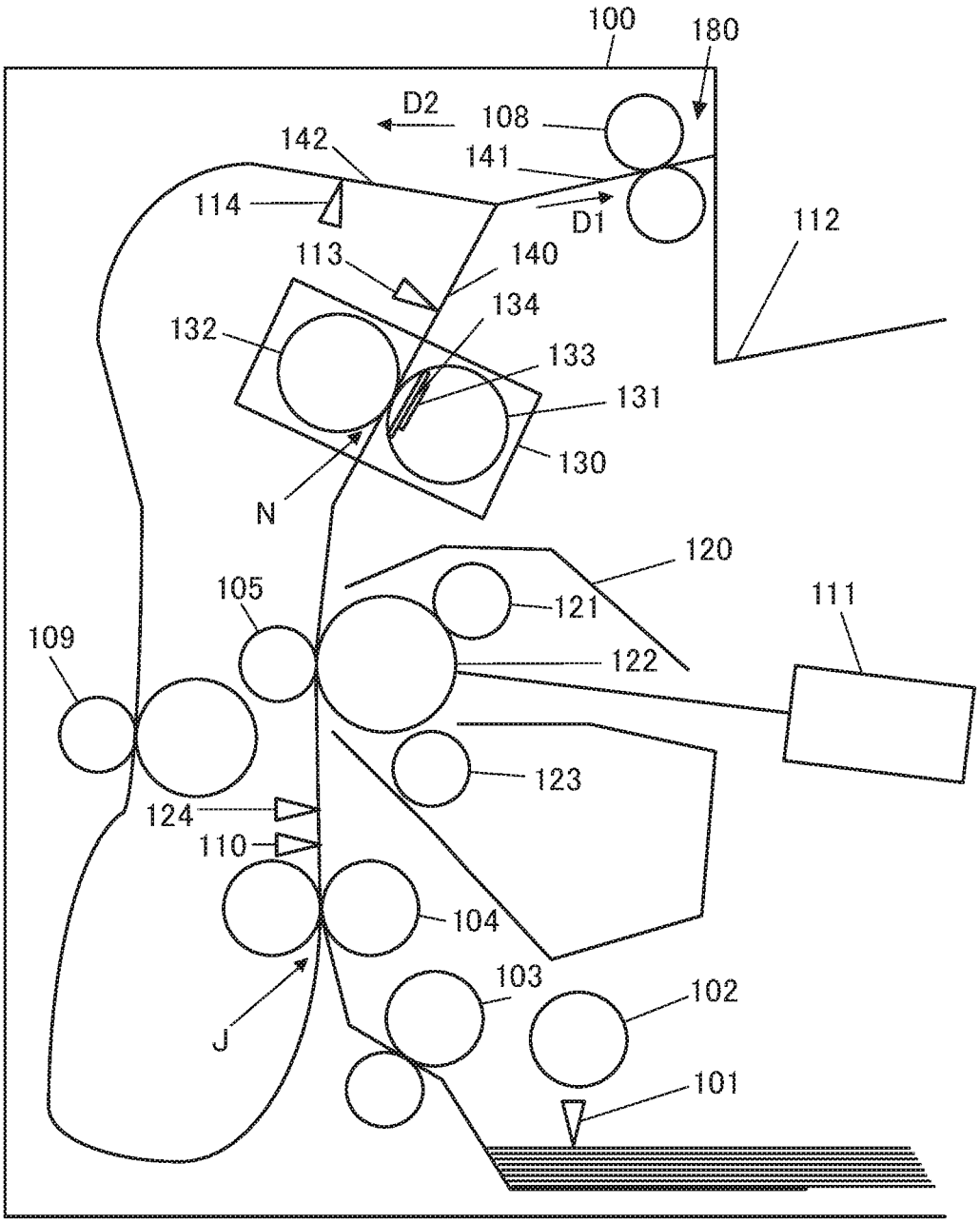
FIG. 1 is a general configuration of an image forming apparatus according to a first to a third embodiment of the present disclosure.

Hereinafter, exemplary embodiments according to the present disclosure will be described. To be noted, in drawings included in descriptions of the present disclosure, the same structures will be put the same reference characters, and overlapping descriptions will be omitted herein.

General Configuration of Image Forming Apparatus

FIG. 1 shows a cross-sectional view of an image forming apparatus 100 according to the embodiments of the present disclosure. The image forming apparatus 100 includes a cartridge 120 which is an image forming unit. The cartridge 120 includes such as a charge roller 121, a photosensitive drum 122 which is an image bearing member of the embodiments, and a developing roller 123, and the cartridge 120 is provided in a manner attachable to and detachable from the image forming apparatus 100.

In the image forming apparatus 100, presence of a sheet stored in a feed cassette is detected with a paper presence/absence sensor 101, and a drive of a main motor 210 (refer to FIG. 2) is started with instruction information (i.e., job) to form the image on the sheet sent from an external apparatus such as a personal computer (PC). The main motor 210 as a drive unit is a driving source which drives a pickup roller 102 serving as a feeding member, a conveyance roller pair 103 serving as a conveyance member, a registration roller pair 104, and a transfer roller 105 serving as a transfer member. Further, the main motor 210 also drives the charge roller 121, the photosensitive drum 122, the developing roller 123, a heating film 131, a pressing roller 132, a sheet discharge roller pair 108, and a duplex roller pair 109. A surface of the photosensitive drum 122 is uniformly charged with a negative polarity at a predetermined electric potential by a charge roller 121. The pickup roller 102 is descended on an uppermost sheet in the feed cassette by driving a feeding solenoid 220 (refer to FIG. 2), and sends out the uppermost sheet toward the registration roller pair 104. The sheet passes through the conveyance roller pair 103 and the registration roller pair 104, and arrives at a detection position of a registration sensor 110.

When the sheet arrives at the detection position of the registration sensor 110, the surface of the photosensitive drum 122 is irradiated with a laser beam from a laser exposing unit 111 in a timing synchronizing with an arrival of the sheet at the transfer roller 105. Herewith, an electrostatic latent image is formed on the surface of the photosensitive drum 122. The registration sensor 110, which is a first detection unit, changes an output signal in accordance with the presence and absence of the sheet in the detection area thereof. The detection position of the registration sensor 110 is between the registration roller pair 104 and the transfer roller 105 in a sheet conveyance direction. At this point, a junction of a duplex conveyance path 142, on which the sheet is conveyed by the duplex roller pair 109, and a transfer conveyance path 140, on which the sheet is conveyed by the transfer roller 105 for a transfer of a toner image onto the sheet, is hereinafter referred to as a junction J (refer to FIG. 1). In the embodiments included in the present disclosure, the detection position of the registration sensor 110 is between the junction J and the transfer roller 105 (refer to FIG. 1). The detection position of the registration sensor 110 is a first detection position of the embodiments included in the present disclosure.

The electrostatic latent image formed on the photosensitive drum 122 is visualized as the toner image by toner which is adhered at a position where the developing roller 123 and the photosensitive drum 122 face each other. When the sheet passes through the transfer roller 105 along with rotation of the photosensitive drum 122, the toner image is transferred on the sheet at a transfer portion between the photosensitive drum 122 and the transfer roller 105. The sheet on which an unfixed toner image is transferred is introduced to a fixing device 130. The fixing device 130 which serves as a fixing unit of the embodiments includes the heating film 131, the pressing roller 132, a thermistor 133, and a heater 134. The sheet on which the unfixed toner image is transferred is heated at a nip portion N formed between the heating film 131 and the pressing roller 132, both of which compose a rotary member pair of the embodiments. The nip portion N is heated to a suitable fixing temperature by the heater 134, which is a heating element. The heater 134 is installed in a manner capable to heat over a whole length of the nip portion N in a width direction perpendicularly intersecting with the sheet conveyance direction.

In specific examples of the heater 134, a ceramic heater which is printed with a resistance heating element on a ceramic substrate, a halogen lamp, and an induction heating unit are included. To be noted, the fixing unit is not limited to a heating film method, for example, a heating roller method in which a layer of a heat resistant elastic material such as silicone rubber is formed on a circumference of a cylindrical metal barrel is acceptable.

Then, the suitable fixing temperature for the heater 134 is preferably determined based on a heat capacity of the sheet on which the unfixed toner image is transferred, and the heat capacity of the sheet described above changes depending on the job, characteristics of the sheet such as a grammage thereof, a quantity of the toner adhered to the sheet, a characteristic of the toner, and other conditions. Thus, the sheet on which the unfixed toner image is transferred is heated at the nip portion N at the suitable fixing temperature, and the toner image is fixed on the sheet. Power supply to the heater 134 is controlled by a controller 200 (refer to FIG. 2) based on a temperature measured by the thermistor 133, which is a temperature measurement unit, to attain the suitable fixing temperature to fix the toner on the sheet. The sheet on which the toner image has been fixed is conveyed with the sheet discharge roller pair 108 in a direction of discharging the sheet to a sheet discharge tray 112 from a transfer conveyance path 140 via a sheet discharge conveyance path 141.

To be noted, in a case of an image formation on both surfaces of the sheet, until a predetermined time will have passed after a trailing edge of the sheet, on which the unfixed toner image was transferred on a front surface (a first surface), has passed through a discharge sensor 113, the sheet is conveyed in the direction of discharging the sheet to the sheet discharge tray 112. A detection position of the discharge sensor 113, which is a second detection unit, is disposed between the fixing device 130 and the sheet discharge roller pair 108 in the sheet conveyance direction. The detection position of the discharge sensor 113 is a second detection position of the embodiments included in the present disclosure. Thereafter, a moving direction of the sheet is reversed by switching a driving direction of the sheet discharge roller pair 108 with a reverse solenoid 230 (refer to FIG. 2). With the sheet discharge roller pair 108, which is a reverse conveyance unit, the sheet is reversed after the trailing edge of the sheet has moved from the transfer conveyance path 140 to the sheet discharge conveyance path 141, and the sheet is delivered from the sheet discharge conveyance path 141 to the duplex conveyance path 142. That is, the reverse solenoid 230 (refer to FIG. 2) and the sheet discharge roller pair 108 cooperate each other and operate as a reverse conveyance unit 180.

A first direction of the present disclosure is a sheet conveyance direction D1 in which the sheet is discharged from the transfer conveyance path 140 to the sheet discharge tray 112 via the sheet discharge conveyance path 141. Further, a second direction of the present disclosure is a sheet conveyance direction D2 in which the sheet is delivered from the sheet discharge conveyance path 141 to the duplex conveyance path 142. To be noted, a leading edge and the trailing edge of the sheet in the present disclosure shall respectively mean a leading edge (a downstream edge in the conveyance direction) and a trailing edge (an upstream edge in the conveyance direction) of the sheet in the sheet conveyance direction on a conveyance path on which the sheet is being conveyed at the time. To be noted, the leading edge of the sheet being conveyed on the transfer conveyance path 140 is the same entity as the trailing edge of the sheet after the sheet has been delivered to the duplex conveyance path 142.

The sheet is sent to the registration roller pair 104 again by the duplex roller pair 109, which is a duplex conveyance unit, disposed on the duplex conveyance path 142. The sheet is conveyed to the transfer roller 105 with the registration roller pair 104, and the toner image is transferred onto a back surface (a second surface) of the sheet. In a case where both surfaces of the sheet are printed, the sheet is conveyed through a section in which the sheet is conveyed from a point where the sheet transferred with the toner image on the front surface has passed through the nip portion N to a point where the leading edge of the sheet arrives at the nip portion N again via the duplex conveyance path 142. The section in which the sheet is conveyed from the point where the sheet transferred with the toner image on the front surface has passed through the nip portion N to the point where the leading edge of the sheet arrives at the nip portion N again via the duplex conveyance path 142 is a predetermined conveyance section (a predetermined section) of the present disclosure. A sheet width sensor 124 is a sensor which changes an output signal in accordance with a length of the sheet in the width direction perpendicularly intersecting with the sheet conveyance direction, and is used to detect a sheet width. A duplex conveyance sensor 114 is used to detect whether or not the sheet reversed by the sheet discharge roller pair 108 does not flow back in a direction to the transfer conveyance path 140, that is, does not flow back against the conveyance direction D1.

First Embodiment

Control Configuration of Image Forming Apparatus

Figure 2:
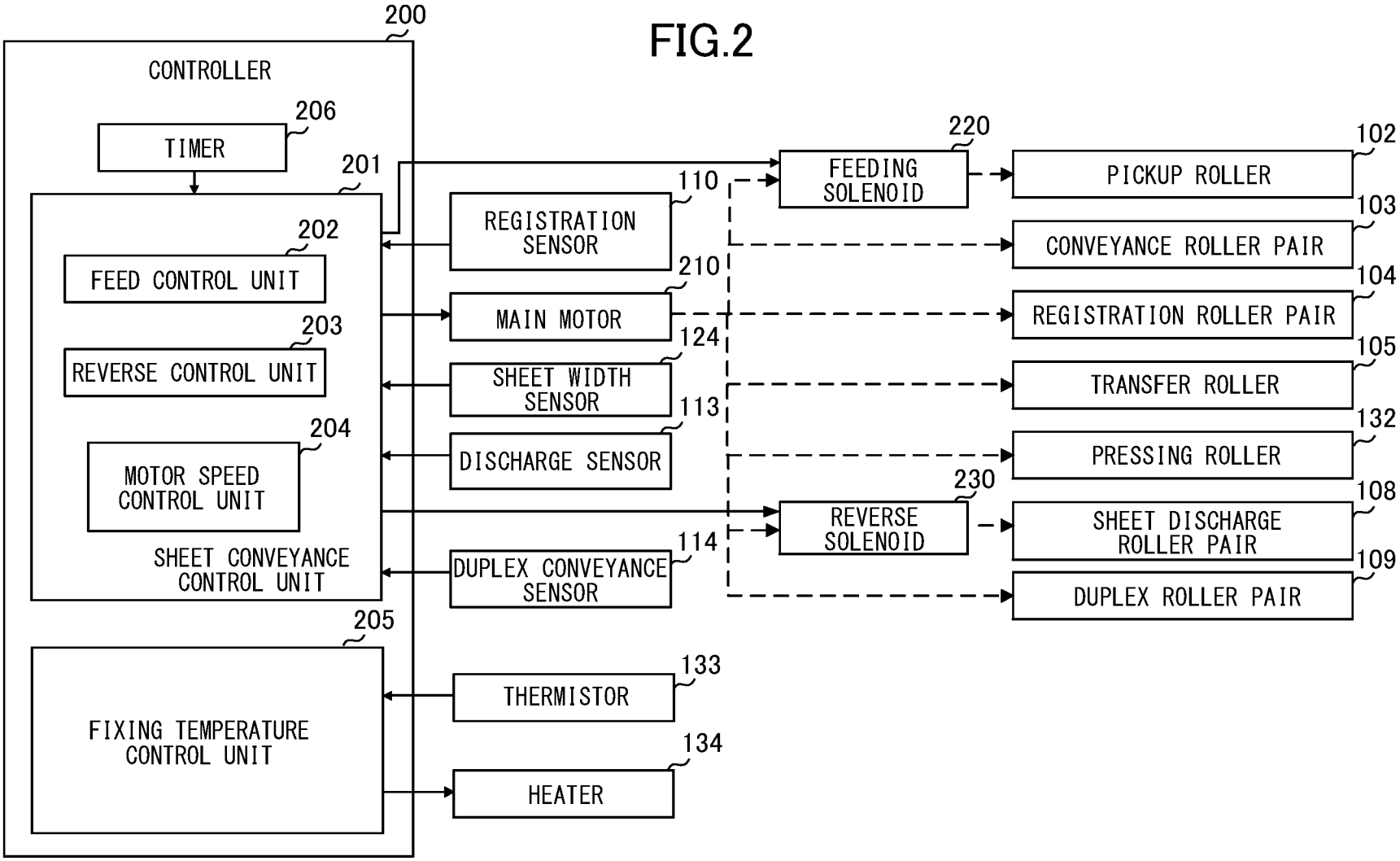
FIG. 2 is a block diagram showing a configuration of a controller according to the first and the second embodiment.

Next, a control configuration of the image forming apparatus 100 of a first embodiment will be described. FIG. 2 is a block diagram showing the control configuration of the image forming apparatus 100. The controller 200 includes hardware such as a central processing unit (CPU) as a calculation unit, a read only memory (ROM), and a random access memory (RAM), and a program stored in the ROM is loaded in the RAM, and the image forming apparatus 100 is controlled by the CPU which executes the program loaded in the RAM. The controller 200 includes a sheet conveyance control unit 201, and a fixing temperature control unit 205. The sheet conveyance control unit 201 includes a feed control unit 202, a reverse control unit 203, and a motor speed control unit 204.

The sheet conveyance control unit 201 controls the drive of the main motor 210. The main motor 210 is a single motor which drives the pickup roller 102, the conveyance roller pair 103, the registration roller pair 104, the transfer roller 105, the pressing roller 132, the sheet discharge roller pair 108, and the duplex roller pair 109. Further, by controlling the drive of the main motor 210, the sheet conveyance control unit 201 controls the sheet conveyance in the image forming apparatus 100. The feed control unit 202 drives the feed solenoid 220, and controls a feed operation of the sheet with the pickup roller 102. The reverse control unit 203 judges based on an output signal of the discharge sensor 113 whether or not the trailing edge of the sheet has passed through the detection position of the discharge sensor 113, and controls a reverse operation of the sheet with the sheet discharge roller pair 108 by driving the reverse solenoid 230. The motor speed control unit 204 controls speeds at a feed and a reversal of the sheet. The fixing temperature control unit 205 controls the power supply to the heater 134 based on the temperature measured by the thermistor 133 so that the temperature of the heater 134 becomes a predetermined temperature (for example, such as the fixing temperature as described above).

Incidentally, in the image forming apparatus 100, the nip portion N of the fixing device 130 is sometimes brought into so-called an excessive temperature rise state where a temperature in the nip portion N becomes higher than the fixing temperature. In other words, the excessive temperature rise state means a state where the temperature is elevated above an allowable range in an at least one of areas in the nip portion N. In this regard, for example, in a case where a duplex image formation, which forms the image on both surfaces of a recording material (hereinafter referred to as a duplex printing), is to be performed, the printing on the back surface is performed while the nip portion N is in the excessive temperature rise state at the printing on the front surface. In the excessive temperature rise state, there is a possibility that a printing quality is degraded at a time of the printing on the back surface since the excessive temperature rise may incur variations in a feed rate of the heating film 131, an excessive dissolution of the toner, and a hot offset.

Further, in the image forming apparatus 100, the printing is performed on the sheet having a variety of width and length. In this respect, especially in a case where the printing is to be performed on a small width sheet, due to a difference in terms of heat consumption between a portion where the sheet is passing (hereinafter referred to as a sheet-passing portion) and a portion where the sheet is not passing (hereinafter referred to as a non-sheet-passing portion), the temperature rise in the non-sheet-passing portion becomes larger. When the non-sheet-passing portion becomes in the excessive temperature rise state, a thermal expansion of the pressing roller 132 becomes not uniform, and the pressing roller 132 becomes liable to deteriorate. Further, it is necessary to consider a heat resistant temperature of the fixing device 130 itself. In addition, in a case where the printing is performed on the small width sheet (such as a postcard), when the non-sheet-passing portion becomes in the excessive temperature rise state during the printing of the front surface, the hot offset sometimes occurs during the printing of the back surface on the sheet-passing portion in adjacent to the non-sheet-passing portion. Further, it may occur that the toner and the like adhered to the pressing roller 132 is melted by the excessive temperature rise in the non-sheet-passing portion and adhered to the heating film 131 or the sheet by the hot offset. To prevent an occurrence of the hot offset, it is necessary to wait a fixing processing of the back surface until the temperature of the non-sheet-passing portion decreases to a certain degree. In this regard, a conveyance operation of the sheet is controlled in this embodiment to secure a cooling time of the nip portion N of the fixing device 130 in the duplex printing.

Flow of Duplex Printing Operation

Figure 3:
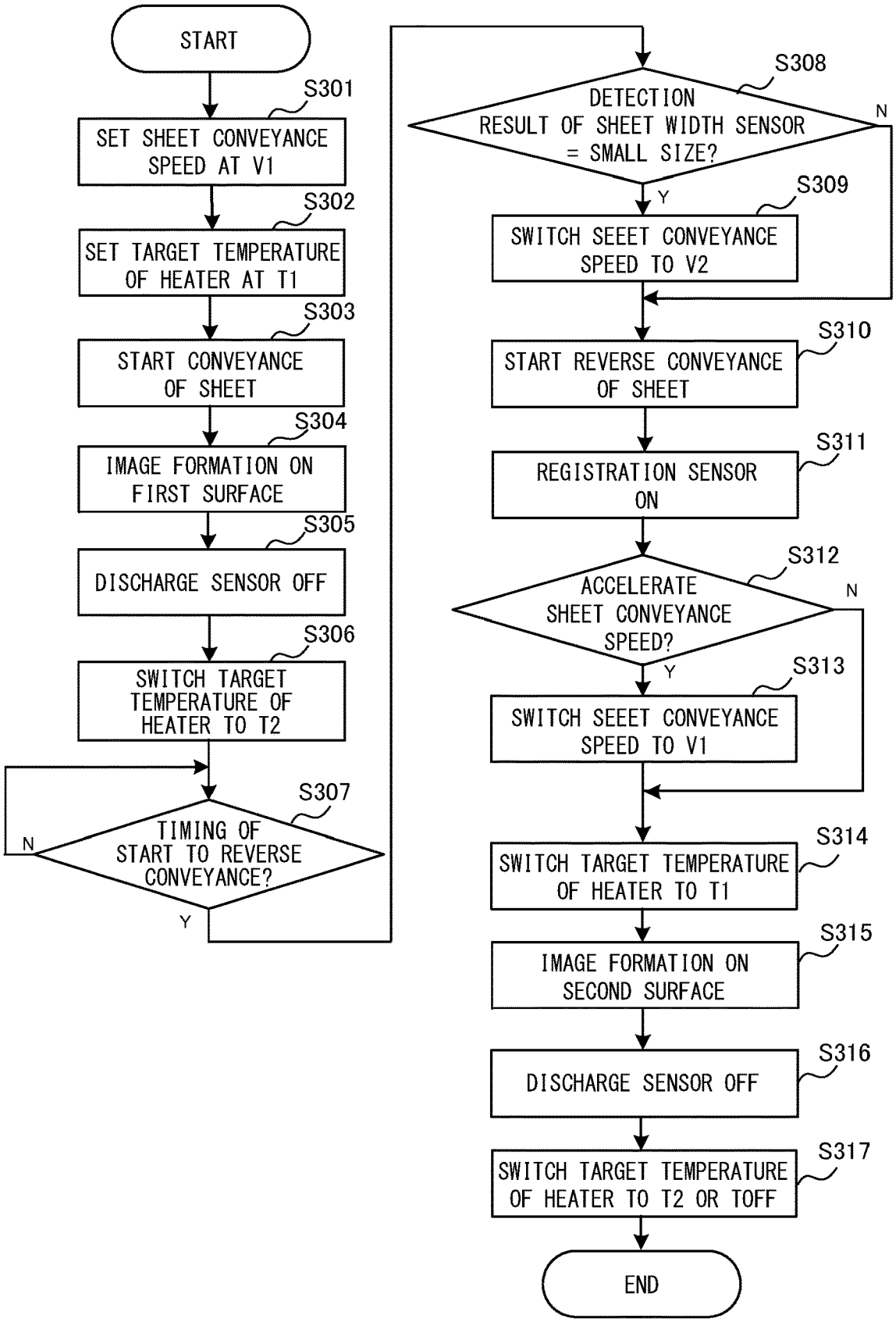
FIG. 3 is a flowchart showing a flow of a duplex printing operation according to the first embodiment.
Figure 4A:
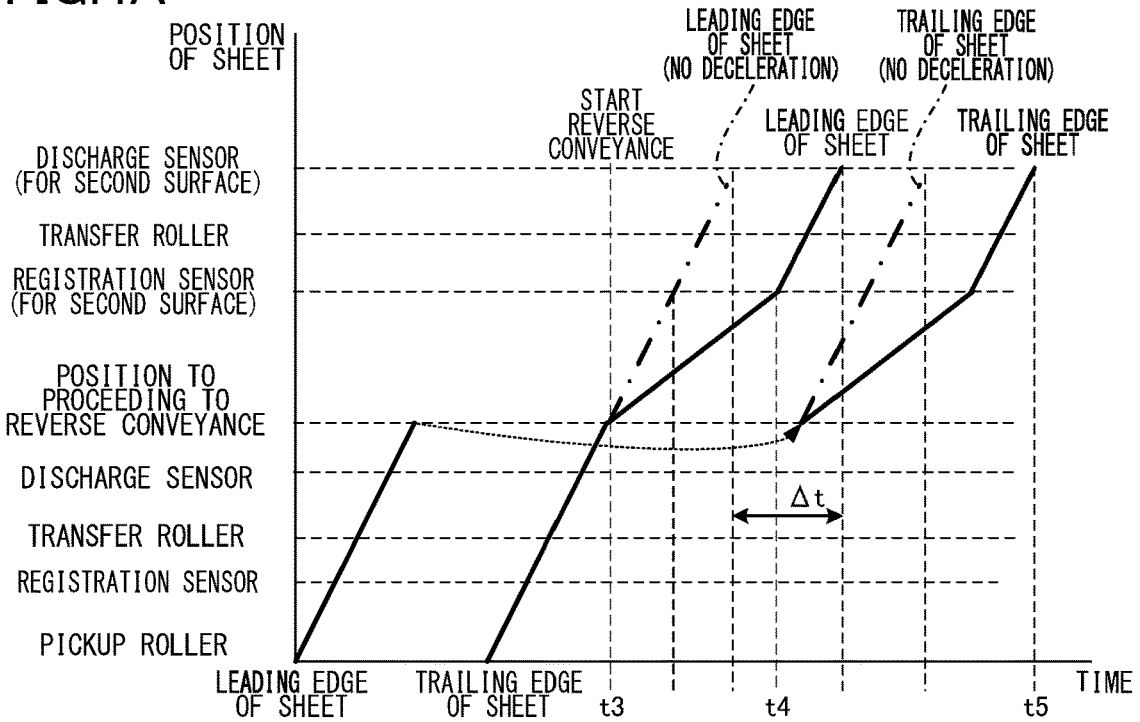
FIGS. 4A, 4B, and 4C respectively illustrate a state of a sheet conveyance in the duplex printing operation, a temperature of a non-sheet-passing portion, and a timing chart according to the first embodiment.
Figure 4B:
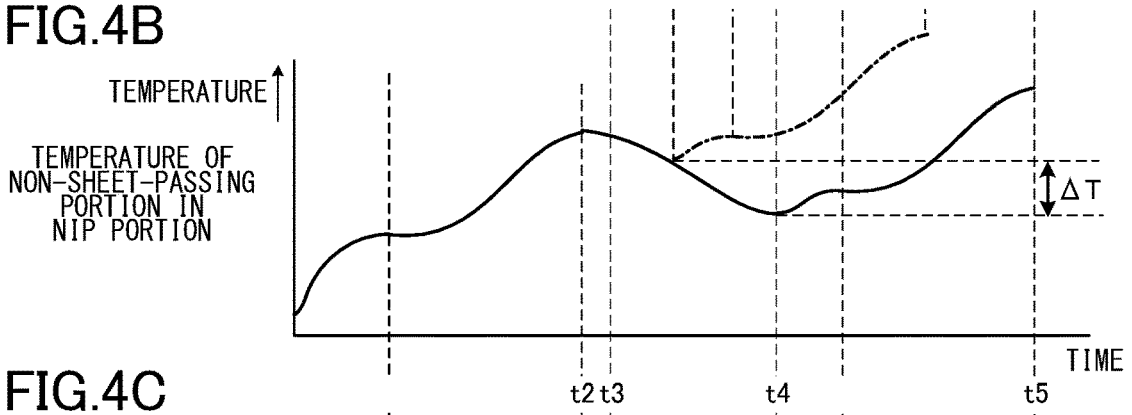
Figure 4C:
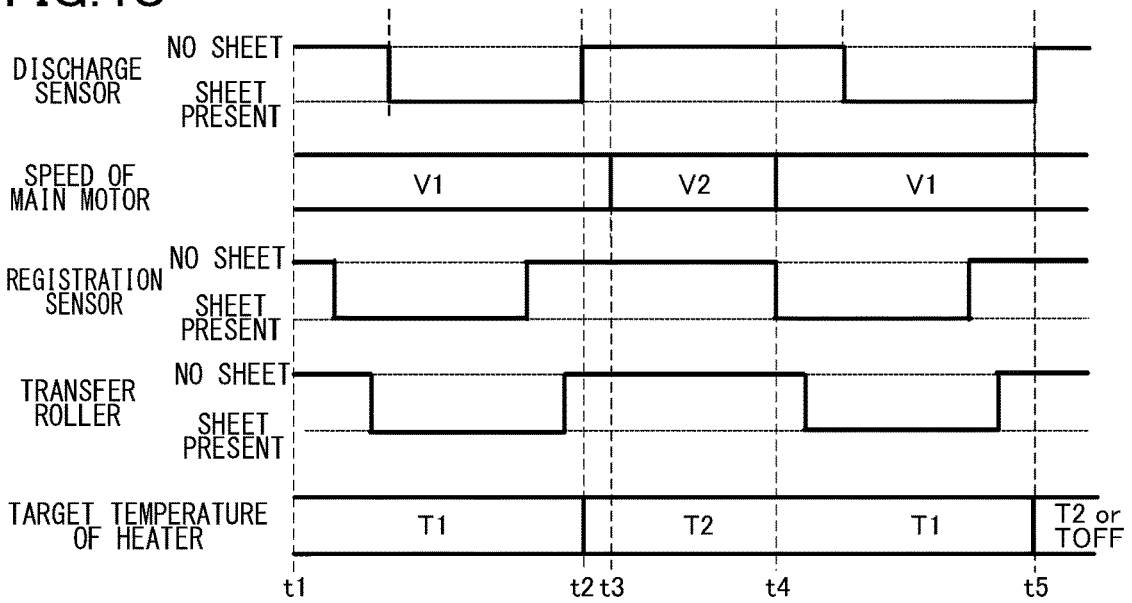

Next, with reference to FIG. 3, a flow of the duplex printing operation of this embodiment will be described. FIG. 3 is a flowchart showing the duplex printing operation which the controller 200 primarily executes in accordance with the control program. That is, each step shown in the flowchart of FIG. 3 is primarily executed by the controller 200. FIG. 4A shows a relation between a position of the sheet and a time at an execution of the flowchart of FIG. 3, and FIG. 4B shows a relation between a temperature of the non-sheet-passing portion and the time. Further, FIG. 4C shows a timing chart of an operation of each unit included in the image forming apparatus 100 at the execution of the flowchart of FIG. 3.

When the job is received from the external apparatus such as the PC (time t1 in FIG. 4C), the controller 200 sets a speed at which the sheet is conveyed by the drive of the main motor 210 at V1 (for example 180 mm/s, step S301) and a target temperature of the heater 134 at T1 (step S302). To be noted, the speed at which the sheet is conveyed by the drive of the main motor 210 is hereinafter referred to as a sheet conveyance speed. Next, a feed of the sheet is started by driving the feed solenoid 220 (step S303). Thereafter, after the image has been formed on the front surface of the sheet (step S304) and the output signal of the discharge sensor 113 has become in an OFF state (step S305, time t2 in FIG. 4C), a temperature decrease processing (cooling down processing) to switch the target temperature of the heater 134 to T2 which is lower than T1 (step S306) is executed.

At this step, the fixing temperature control unit 205 controls the power supply to the heater 134 by feedback control based on the temperature measured by the thermistor 133 to bring the temperature of the heater 134 to the target temperature. As described above, the heater 134 is controlled to attain the suitable temperature at the nip portion N for fixing the toner adhered to the sheet. That is, in this embodiment, the temperature of the heater 134, at which the nip portion N is brought to the suitable temperature to fix the toner adhered to the sheet, is a first temperature. Further, the target temperature of the heater 134 is switchable at least between T1, which is the first temperature of this embodiment, and T2 which is lower than T1 and which is a second temperature of this embodiment. After the target temperature has been changed to T2, the controller 200 waits for a timing of a start of a reversal (step S307). Then, at the timing of the start of the reversal (YES at the step S307, time t3 in FIG. 4C), the controller 200 judges based on the detection result of the sheet width sensor 124 whether or not the sheet size is small (step S308).

In a case where the detection result of the sheet width sensor 124 is small (YES at the step S308), a deceleration processing to switch the sheet conveyance speed to V2, which is slower than V1, is executed (step S309). In this embodiment, by the deceleration processing, the sheet conveyance speed is switched to V2 (90 mm/s), which serves as a second speed in this embodiment and is a half speed of V1 serves as a first speed in this embodiment, and the processing proceeds to a step S310. To be noted, in a case where the detection result of the sheet width sensor 124 is not small (NO at the step S308), the processing proceeds to the step S310 while maintaining the sheet conveyance speed at V1. Then, the reverse conveyance with the sheet discharge roller pair 108 is executed (step S310). The sheet is sent to the duplex conveyance path 142 with the sheet discharge roller pair 108, and conveyed to the registration roller pair 104 with the duplex roller pair 109.

When the leading edge of the sheet has passed through the detection position of the registration sensor 110, an output signal of the registration sensor 110 becomes in an ON state (step S311, time t4 in FIG. 4C). When the output signal of the registration sensor 110 becomes in the ON state, the controller 200 waits for the timing to arrive at an acceleration timing of the main motor 210 (step S312).

At this point, the acceleration timing of the main motor 210 is set not to decrease a productivity of an image forming operation on the back surface of the sheet, and it is acceptable if the main motor 210 is set to be accelerated before the image formation on the back surface starts. In this embodiment, the acceleration timing of the main motor 210 is set at the timing at which the leading edge of the sheet, of which the image is to be formed on the back surface, arrives at the registration sensor 110 (time t4 in FIG. 4C). Then, at the acceleration timing of the main motor 210, an acceleration processing to switch the sheet conveyance speed from V2 to V1, which is faster than V2, is executed, and the processing proceeds to a step S314 (step S313: YES at the step S312).

As described above, at the step S309, the deceleration processing of the main motor 210 is performed so that a length of a sheet conveyance time for the leading edge of the back surface of the sheet to arrive at the nip portion N of the fixing device 130 after the sheet has been reversed is longer in comparison with a case where a speed of the main motor 210 is maintained at a constant. Then, since the main motor 210 is accelerated in the timing synchronizing with the image formation on the back surface, it is possible to cool the nip portion N of the fixing device 130 without hurting the productivity of the duplex printing operation.

To be noted, at the step S312, in a case where the sheet conveyance speed is V1, that is, the sheet conveyance speed has not been switched from V1 to V2 at the step S309 (NO at the step 312), the processing proceeds to the step S314 without performing the processing of the step S313. Next, having performed a temperature increase processing (heating up processing) to switch the target temperature from T2 to T1, which is higher than T2 (step S314), the toner image is transferred and fixed on the back surface of the sheet (step S315). Thereafter, when the trailing edge of the sheet has passed through the detection position of the discharge sensor 113 and the discharge sensor 113 has become in the OFF state (step S316, FIG. 4C: time t5), the target temperature of the heater 134 is switched to T2 or TOFF (step S317) and the processing is ended. To be noted, TOFF mentioned here is an example of temperatures which correspond to the temperature of the nip portion N of the fixing device 130 in a non-printing operation of the image forming apparatus 100.

As described above, in this embodiment, it is possible to perform a first mode (NO at the steps S308 and S312), where the sheet conveyance speed is maintained at V1, and a second mode (YES at the steps S308 and S312), where the deceleration and the acceleration processing to decelerate and accelerate the sheet conveyance speed are performed. In the second mode, the length of the sheet conveyance time for the predetermined section is longer by as much as Δt (refer to FIG. 4A) than the first mode where the sheet conveyance speed is maintained at the constant. The length of the sheet conveyance time for the predetermined section in a case of an execution of the first mode is a first time length of this embodiment, and the length of the sheet conveyance time in a case where the length of the sheet in the width direction is short, that is, in a case of the execution of the second mode is a second time length.

Further, in this embodiment, the temperature decrease processing is performed during the conveyance of the sheet in the section (the predetermined section), that is, during a period in which the sheet is conveyed through the section from the point where the trailing edge of the sheet with toner image fixed on the front surface has passed through the nip portion N of the fixing device 130 to the point where the leading edge of the aforementioned sheet arrives at the nip portion N of the fixing device 130. The temperature decrease processing in this embodiment means a switch of the target temperature of the heater 134 from T1, which is the temperature to fix the toner image on the sheet, to T2, which is lower than T1.

In the second mode, the deceleration processing of the main motor 210 is performed to make the length of the sheet conveyance time from the reversal of the sheet to the arrival of the leading edge of the sheet at the nip portion N of the fixing device 130 longer in comparison with the first mode. Further, in the second mode, the temperature decrease processing to decrease the target temperature of the heater 134 is performed during the deceleration processing. Herewith, in a case where the deceleration processing of the main motor 210 is performed, the temperature of the non-sheet-passing portion in the nip portion N at a time at which the leading edge of the back surface of the sheet passes through the detection position of the registration sensor 110, is lower by as much as ΔT in comparison with a case of not performing the deceleration processing (refer to FIG. 4B). Thus, it is possible to cool the temperature rise at the nip portion N due to the image formation on the front surface of the sheet before the fixing processing of the toner image on the back surface of the sheet, and prevent the excessive temperature rise of the fixing device 130 in the duplex printing.

Further, in this embodiment, by performing the deceleration and the acceleration processing in the second mode during the sheet conveyance in the predetermined section, a longer conveyance time than the first mode is attained. In this regard, as an alternative to attain modes of different lengths of the conveyance times, a configuration to provide a mechanism such as a clutch which, by disengaging driving of rollers, temporarily stops the sheet conveyance after the printing on the front surface and cools the nip portion N may be considered. Further, it may be considered to provide different motors, which are independent each other, for rotation of the fixing device 130 and the conveyance of the sheet. On the other hand, in this embodiment, with a simple configuration without providing additional actuators described above, a difference in the lengths of the conveyance times is attained and it is possible to secure the cooling time to suppress the excessive temperature rise.

Further, in a case where the length of the sheet in the width direction is a first width (for example, an A4 size), the first mode to maintain the conveyance speed of the main motor 210 at the constant is executed. On the other hand, in a case where the length of the sheet in the width direction is a second width (for example, the postcard size) which is shorter than the first width, the second mode is executed. Accordingly, in this embodiment, the length of the sheet conveyance time in the predetermined section is longer by as much as Δt (refer to FIG. 4A) in the case of shorter in the length of the sheet in the width direction (for example, the postcard size) in comparison with the case of longer in the length of the sheet in the width direction (for example, the A4 size). That is, in the case where the length of the sheet in the width direction is short, the length of the sheet conveyance time when the target temperature of the heater 134 is set at a low temperature is lengthened. Accordingly, in this embodiment, a so-called non-sheet-passing portion excessive temperature rise, in which a temperature of a portion where the nip portion N does not abut on the sheet (the non-sheet-passing portion) is higher than a temperature of a portion where the nip portion N abuts on the sheet (sheet-passing portion), is suppressed.

Further, in this embodiment, both in the first mode and in the second mode, the conveyance speed of the sheet which is passing through the nip portion N is maintained at V1 as a first speed. For explanation of an advantage of this configuration, an image forming apparatus in which the conveyance speeds on the transfer conveyance path 140 and the duplex conveyance path 142 are set at the same in the second mode and at slower (for example, 90 mm/s) than the conveyance speed in the first mode (for example 180 mm/s) is considered as a comparative example. In the second mode of this comparative example, the length of the conveyance time in the predetermined section is equal to this embodiment, and an occurrence of the excessive temperature rise in the non-sheet-passing portion is similarly suppressed. However, in the second mode of the comparative example, the productivity of the duplex printing operation decreases due to a slow conveyance speed on the transfer conveyance path 140 which defines a process speed (i.e., a length of the image formed in a sub-scanning direction in a unit of time). That is, with the second mode of this embodiment, it is possible to suppress the occurrence of the excessive temperature rise in the non-sheet-passing portion while reducing a degree of decrease in the productivity of the duplex printing operation in comparison with the first mode.

To be noted, if V2 is further decelerated to a speed (for example 60 mm/s) slower than the aforementioned speed, it is possible to protect the fixing device 130 more surely. On the other hand, it is acceptable to increase V2 faster (for example 120 mm/s) than the aforementioned speed to improve the productivity of the duplex printing operation. Further, in this embodiment, the section to decrease the conveyance speed is set at a section in which the sheet is conveyed from a time when the reversal of the sheet has been started through a time when the leading edge of the back surface of the sheet arrives at the registration sensor 110. However, other than the section described above, to reduce a deceleration time of the sheet conveyance speed for a purpose of improving the productivity of the duplex printing operation, it is acceptable to shorten the section to an extent to which a damage of the fixing device 130 by the excessive temperature rise does not occur.

Second Embodiment

In the first embodiment, in the case where the sheet is the small size in the duplex printing, the excessive temperature rise in the non-sheet-passing portion of the nip portion N of the fixing device 130 is suppressed by executing the second mode. In a second embodiment, a configuration in which the sheet conveyance speed is determined based on a sheet length L which is a length of the sheet in the conveyance direction thereof and a sheet width W which is a length of the sheet in a direction perpendicularly intersecting with the conveyance direction thereof will be described. To be noted, in this embodiment, the same configuration and step as the first embodiment are put the same reference characters, and overlapping descriptions will be omitted herein.

Flow of Duplex Printing Operation

Figure 5:
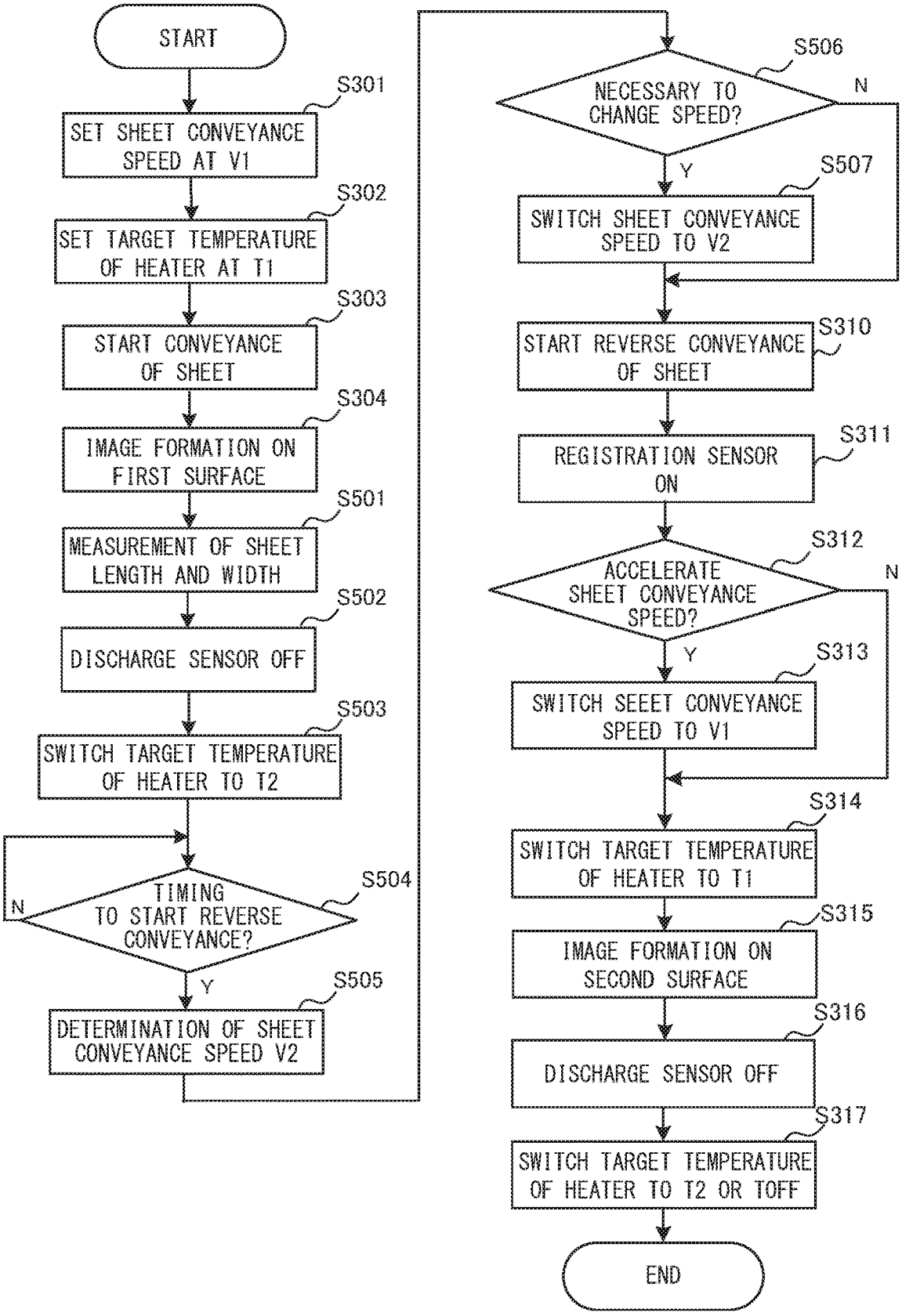
FIG. 5 is a flowchart showing a flow of a duplex printing operation according to the second embodiment.

With reference to FIG. 5, a flow of a duplex printing operation in this embodiment will be described. FIG. 5 shows a flowchart of the duplex printing operation which is primarily performed by the controller 200 in accordance with a control program. That is, each step illustrated in the flowchart of FIG. 5 is executed primarily by the controller 200. A control configuration of the image forming apparatus 100 of this embodiment is the same as the first embodiment. This embodiment is different from the first embodiment in a configuration where a plurality of sheet widths (less than 148 mm, equal to or more than 148 mm and less than 200 mm, and equal to or more than 200 mm, for example) are discriminative based on the output signal of the sheet width sensor 124. Further, this embodiment is different from the first embodiment in a configuration where the motor speed control unit 204 is capable of changing the sheet conveyance speed at three different speeds (180, 90, 60 mm/s for one example and 180, 120, and 90 mm/s for another example).

Since the processing from the step of receiving the job to the step of the image formation on the front surface of the sheet (the steps from S301 to S304) is the same as the first embodiment, the description is omitted herein. When the image has been formed on the front surface of the sheet, the sheet length L and the sheet width W are measured (step S501). To be noted, it is possible to determine the sheet length L and the sheet width W from duration of a time, during which the output signals from the sheet width sensor 124 and the registration sensor 110 are indicating the presence of the sheet, and the sheet conveyance speed V1. Further, other than this method, a configuration in which the controller 200 discriminates the sheet length L and the sheet width W based on information of a sheet size instructed in the job is also acceptable. After the sheet length L and the sheet width W have been determined, when the output signal of the discharge sensor 113 is changed to the OFF state (step S502) due to the conveyance of the sheet fixed with the toner image, the temperature decrease processing to switch the target temperature of the heater 134 to T2 is executed (step S503). At this point, regarding a relation between the temperatures T1 and T2 of the heater 134, T1 is also larger than T2 in this embodiment similar to the first embodiment, and it is possible to switch the target temperature of the heater 134 between the first temperature T1 and the second temperature T2 which is lower than T1. After the target temperature of the heater 134 has been set at T2, the controller 200 waits for the timing of the start of the reversal (step S504), and determines the sheet conveyance speed in the second mode based on the sheet length L and the sheet width W at the timing of the start of the reversal (step S505). Then, whether or not it is necessary to execute the deceleration processing is judged (step S506) based on the result of the step S505. In this embodiment, the sheet conveyance speed is determined based on a relation of the sheet length L to the sheet width W as shown in FIG. 6.

FIG. 6 is a diagram showing an example of a relation among the sheet length L, the sheet width W, and the sheet conveyance speed in this embodiment. As shown in FIG. 6, in a case where the sheet width is equal to or more than 200 mm (for example the sheet width at 210 mm), the first mode in which the sheet conveyance speed is maintained at the constant is executed. On the other hand, in a case where the sheet width is less than 200 mm (for example the sheet width at 198 mm), the second mode in which the deceleration and the acceleration processing of the sheet conveyance speed are performed is executed. In this embodiment, a first width is the sheet width W at which the first mode is executed, and a second width is the sheet width W at which the second mode is executed. Further, in the deceleration processing of the second mode, the sheet conveyance speed is determined to be 60 mm/s in a case where the sheet length L is equal to or more than 270 mm, and 90 mm/s in a case where the sheet length L is less than 210 mm That is, in this embodiment, when a second speed in a first case where the sheet length L is a first length is referred to as a first value, an extent of the deceleration of the sheet conveyance speed in a second case where the sheet length L is a second length which is larger than the first length is increased, and the second speed in the second case is set at a second value which is smaller than the first value. Examples of the first and the second length of this embodiment are respectively 190 mm and 250 mm, and the first and the second value are respectively set at 90 mm/s and 60 mm/s in this embodiment.

Further, in FIG. 6, in a case where the sheet length L is equal to or more than 210 mm and less than 270 mm and the sheet width W is equal to or more than 148 mm and less than 200 mm, the sheet conveyance speed is determined to be 90 mm/s. Further, in a case where the sheet length L is equal to or more than 210 mm and less than 270 mm and the sheet width W is less than 148 mm, the sheet conveyance speed is determined to be 60 mm/s.

At this point, in a case where the sheet width W, at which the second mode is executed, is less than 148 mm, the sheet width W (for example 130 mm) is a third width. At this time, in a case where the sheet length L is a third length (for example the sheet length L at 250 mm) which is longer than the first length and shorter than the second length, the second speed is the second value (60 mm/s, refer to FIG. 6) in a case where the sheet width W is the third width (130 mm). On the other hand, in a case where the sheet length L is the third length and the sheet width W is a fourth width (for example 160 mm) which is shorter than the first width and longer than the third width, the second speed is the first value (90 mm/s).

In this embodiment, when the second speed in the first case where the sheet length L is the first length is referred to as the first value, the extent of the deceleration of the sheet conveyance speed in a third case where the sheet length L is the third length which is longer than a first length and shorter than the second length is changed corresponding to the sheet width W. In the third case, if the sheet width W is the third width which is shorter than the first width, the extent of the deceleration of the sheet conveyance speed is larger than the case of the first value, and the second speed becomes the second value which is smaller than the first value. Meanwhile, in the third case, if the sheet width W is the fourth width which is shorter than the first width and longer than the third width, the extent of the deceleration of the sheet conveyance speed is smaller than the second value, and the second speed becomes the first value which is larger than the second value. In this embodiment, an example of the third length is 260 mm, and the examples of the third and the fourth width are respectively 130 mm and 160 mm.

As described above, the sheet conveyance speed is determined at the step S506. Then, as a result of the step S505, in a case where the deceleration of the sheet conveyance speed is executed (YES at the step S506), the sheet conveyance speed is switched from V1 to V2 which is slower than V1 (step S507). Since the processing after the step S507 is the same as the first embodiment, descriptions are omitted herein.

Incidentally, the temperature rise at the non-sheet-passing portion in the nip portion N becomes the larger when the sheet width W becomes the smaller and the sheet length L becomes the longer. That is, the excessive temperature rise at the non-sheet-passing portion in the nip portion N is smaller in a case where the sheet width W is more than 200 mm in comparison with a case where the sheet width W is less than 200 mm. In this regard, the second mode to perform the deceleration processing is executed in this embodiment in a case where the length of the sheet in the width direction is less than 200 mm. Further, in an execution of the second mode, the sheet conveyance speed (V2) is determined based on the relation between the sheet length L and the sheet width W. As described above, in this embodiment, it is possible to choose necessary or unnecessary to execute the second mode and the sheet conveyance speed in the deceleration processing based on the relation between the sheet length L and the sheet width W Herewith, in this embodiment, by changing the extent of the deceleration of the conveyance speed at the duplex printing in accordance with a degree of a possibility of the occurrence of the excessive temperature rise at the non-sheet-passing portion depending on the sheet size, the decrease in the productivity of the duplex printing is prevented to an extent possible, and the excessive temperature rise in the nip portion N of the fixing device 130 is suppressed.

Third Embodiment

In the first embodiment, in the case where the sheet is the small size, the excessive temperature rise at the non-sheet-passing portion in the nip portion N of the fixing device 130 in the duplex printing is suppressed by executing the second mode. In a third embodiment, thermistors 133*a* and 133*b* which are capable of measuring a temperature are disposed at the center and edge portion of the nip portion N in the width direction perpendicularly intersecting with the sheet conveyance direction. Then, a configuration in which the necessity to perform the second mode and the sheet conveyance speed at the deceleration processing in the second mode are determined based on a temperature difference between the center and the edge portion of the nip portion N at which the temperatures are measured with the thermistors 133*a* and 133*b* will be described. To be noted, in this embodiment, the same configuration and step as the first embodiment are put the same reference characters, and overlapping descriptions will be omitted herein.

Control Configuration of Image Forming Apparatus

Figure 7:
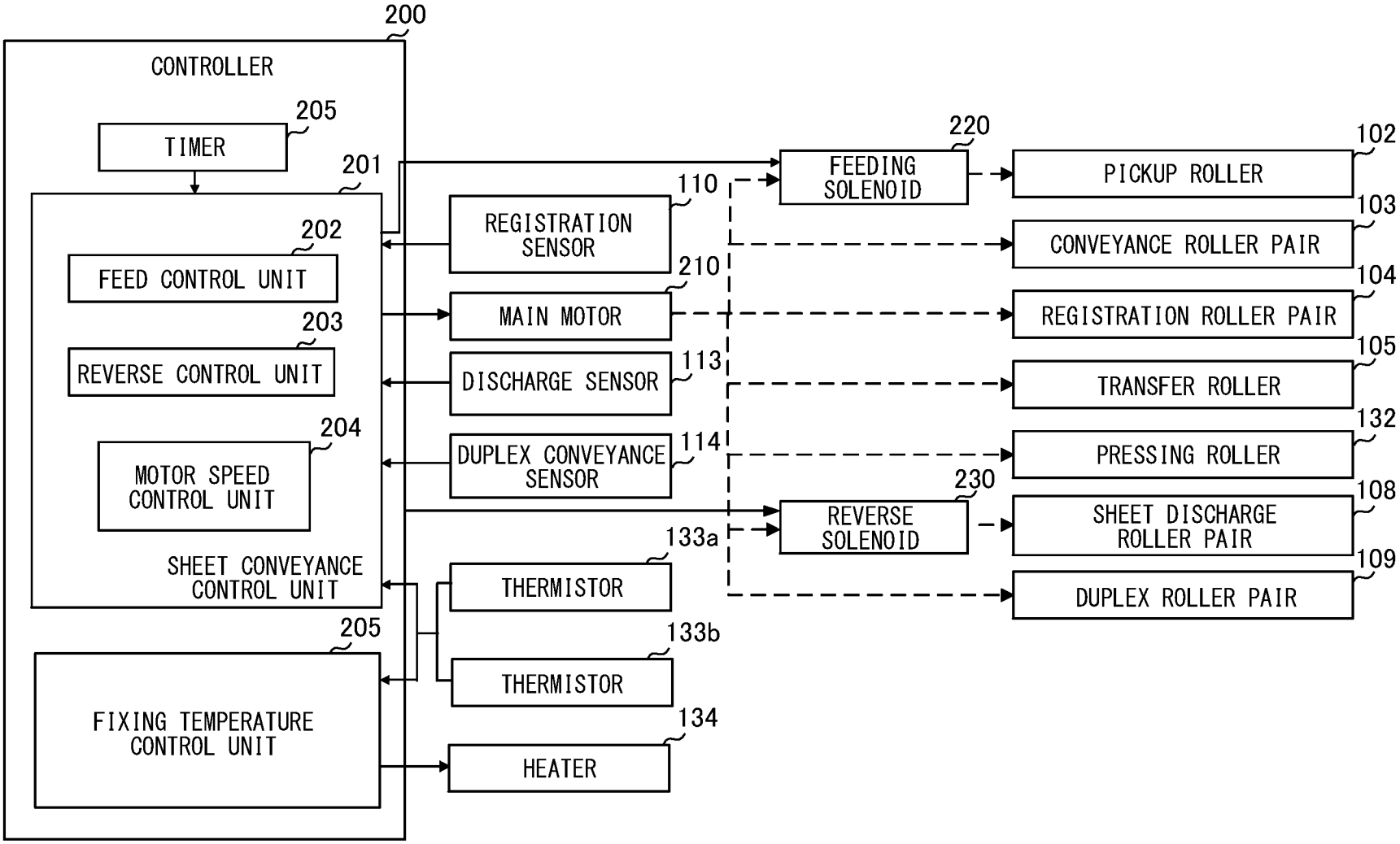
FIG. 7 is a block diagram showing a function and configuration of a controller according to the third embodiment.

At first, with reference to FIG. 7, a control configuration of an image forming apparatus 100 of this embodiment will be described. FIG. 7 is a block diagram showing a control configuration of the image forming apparatus 100 according to this embodiment. To be noted, the same control configuration in FIG. 7 as the control configuration of the image forming apparatus 100 in the first embodiment described in FIG. 2 is put the same reference characters, and overlapping description will be omitted herein. As described above, the image forming apparatus 100 of this embodiment includes the thermistors 133*a* and 133*b*. The thermistor 133*a*, which is a first temperature measurement unit of this embodiment, measures the temperature at the center portion of the nip portion N in the width direction. Further, the thermistor 133*b*, which is a second temperature measurement unit of this embodiment, is disposed with a space from the thermistor 133*a* in the width direction, and measures a temperature at the edge portion of the nip portion N. Detection results of the thermistors 133*a* and 133*b* are input to the sheet conveyance control unit 201 and the fixing temperature control unit 205. Since the control configurations other than the thermistors 133*a* and 133*b* are the same as the first embodiment, overlapping descriptions will be omitted herein.

Flow of Duplex Printing Operation

Figure 8:
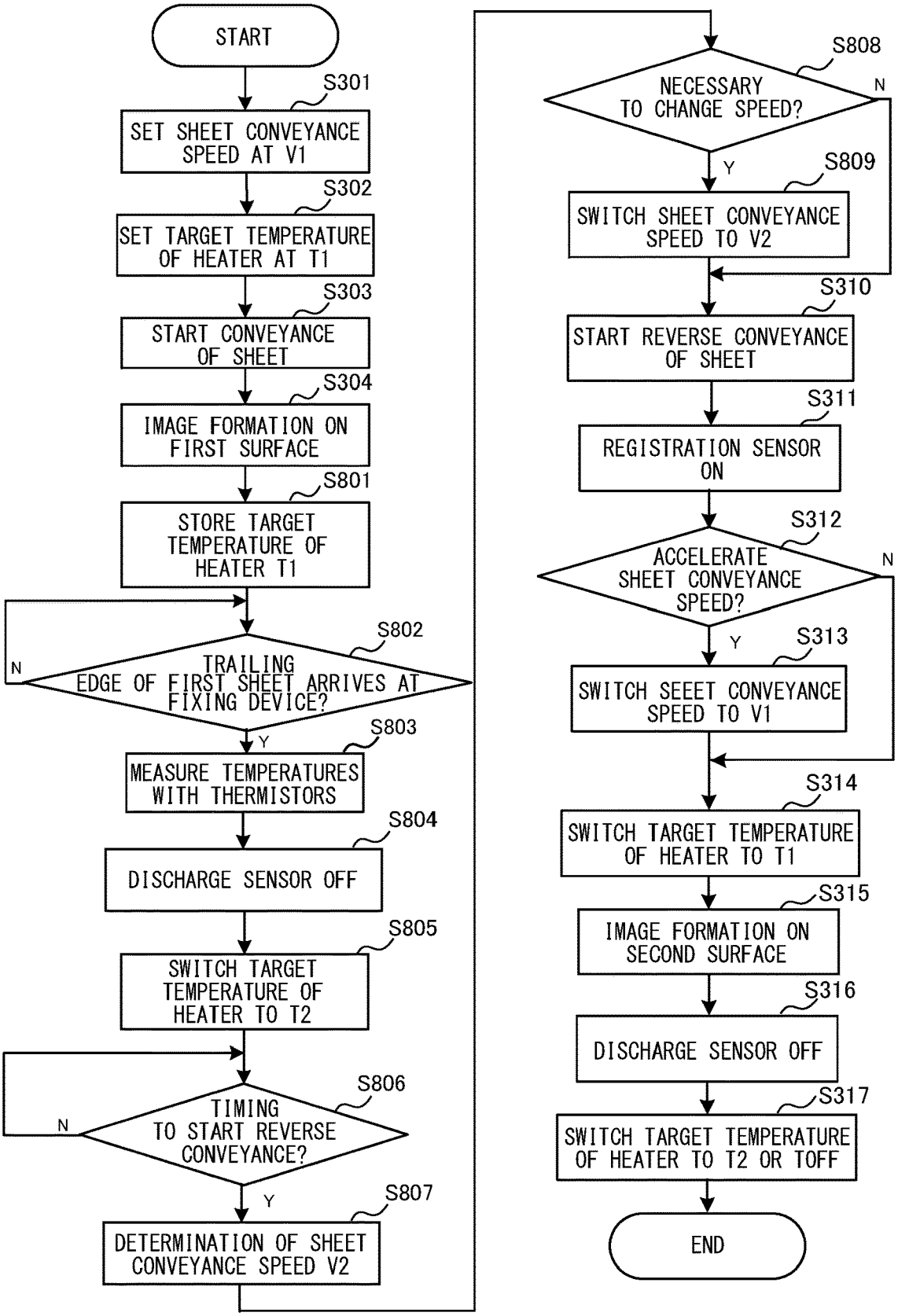
FIG. 8 is a flowchart showing a flow of a duplex printing operation according to the third embodiment.

Next, with reference to FIG. 8, a flow of a duplex printing operation in this embodiment will be described. FIG. 8 is a flowchart of the duplex printing operation which is primarily executed by the controller 200 in accordance with the control program. That is, each step included in the flowchart of FIG. 8 is primarily executed by the controller 200. Since the processing from the step of receiving the job through the step of the image formation on the front surface of the sheet is the same as the first embodiment, overlapping description is omitted herein.

In this embodiment, the controller 200 temporarily store the target temperature T1 of the heater 134 in a memory such as the RAM (step S801) at the image formation on the front surface of the sheet. When the image formation on the front surface of the sheet has been performed, the sheet is conveyed to the fixing device 130. Then, the controller 200 waits until the trailing edge of the sheet in the conveyance direction arrives at the nip portion N of the fixing device 130, and, when the trailing edge of the sheet arrives at the nip portion N (YES at step S802), measures the temperatures at the center and the edge portion of the nip portion N with the thermistors 133*a* and 133*b* (step S803). When the sheet passes through the nip portion N and thereafter the detection position of the discharge sensor 113 (step S804), the temperature decrease processing to switch the target temperature of the heater 134 to T2 is executed (step S805).

At this point, as the relation between the temperatures T1 and T2 of the heater 134 is the same as the first embodiment, T1 is higher than T2, and also in this embodiment it is possible to switch the target temperature of the heater 134 between T1 and T2 which is lower than T1. After the target temperature of the heater 134 has been set at T2, the controller 200 waits for the timing of the start of the reversal (step S806). Having arrived at the timing of the start of the reversal (YES at the step S806), the sheet conveyance speed in the second mode is determined based on the detection results of the thermistors 133*a* and 133*b* (step S807). In this embodiment, as shown in FIG. 9, the sheet conveyance speed is determined based on a measured temperature difference ΔT, which is a difference between the temperatures measured by the thermistors 133*a* and 133*b*, and the target temperature T1 of the heater 134 at the image formation on the front surface of the sheet.

FIG. 9 shows an example of a relation among the measured temperature difference ΔT between the thermistors 133*a* and 133*b*, the target temperature T1 of the heater 134, and the sheet conveyance speed. First, when the measured temperature difference ΔT between the thermistors 133*a* and 133*b* is focused, as shown in FIG. 9, the deceleration processing to decrease the sheet conveyance speed is performed in a case where the measured temperature difference ΔT between the thermistors 133*a* and 133*b* is equal to or more than 40° C. That is, the measured temperature difference ΔT between the thermistors 133*a* and 133*b* in a case where the deceleration processing is not performed (in a case of the execution of the first mode) is referred to as a first temperature difference (less than 40° C., for example 35° C.). At this time, in a case where the measured temperature difference ΔT is a second temperature difference (for example 45° C.) which is larger than the first temperature difference, the second mode is executed. That is, in this embodiment, the measured temperature difference ΔT between the thermistors 133*a* and 133*b* in a case where the first mode is executed is the first temperature difference, and the measured temperature difference ΔT between the thermistors 133*a* and 133*b* in a case where the second mode is executed is the second temperature difference. Examples of the first and the second temperature difference in this embodiment are respectively 35° C. and 45° C.

Next, focusing on a relation between the measured temperature difference ΔT between the thermistors 133*a* and 133*b* and the target temperature T1 of the heater 134, the deceleration processing will be considered. As shown in FIG. 9, in this embodiment, in a case where the target temperature T1 of the heater 134 is less than 180° C. and the measured temperature difference ΔT between the thermistors 133*a* and 133*b* is less than 40° C., the first mode in which the deceleration processing is not performed is executed. That is, in a case where the target temperature T1 of the heater 134 is equal to or higher than 180° C. or the measured temperature difference ΔT between the thermistors 133*a* and 133*b* is equal to or higher than 40° C., the second mode in which the deceleration processing is performed is executed. As described above, the target temperature T1 of the heater 134 at the fixing processing is a value which is determined based on the heat capacity of the sheet and toner adhered to the sheet (hereinafter referred to as a heat capacity). That is, the target temperature of the heater 134 at the fixing processing becomes the higher in a case where the heat capacity becomes the larger.

Then, in a case where the deceleration processing of the main motor 210 is not performed (in a case of the execution of the first mode) in accordance with the relation between the measured temperature difference ΔT between the thermistors 133*a* and 133*b* and the heat capacity, the measured temperature difference ΔT and the heat capacity are respectively referred to as a third temperature difference (for example 38° C.) and a first quantity (example of a quantity will be indicated by a corresponding target temperature T1 of the heater 134 to the quantity, for example 145° C. in case of the first quantity). At this time, in a case where the measured temperature difference ΔT is a fourth temperature difference (for example 46° C.) which is larger than the third temperature difference or the heat capacity is a second quantity (for example 185° C.) which is larger than the first quantity, the second mode in which the deceleration processing of the main motor 210 is performed is executed. Further, in the deceleration processing, the sheet conveyance speed is determined based on the relation between the measured temperature difference ΔT between the thermistors 133*a* and 133*b* and the heat capacity. As shown in FIG. 9, the sheet conveyance speed in the second mode is determined to be 90 mm/s in a case where the target temperature T1 of the heater 134 is lower than 140° C. On the other hand, in a case where the target temperature T1 of the heater 134 is equal to or higher than 140° C. and lower than 180° C., the sheet conveyance speed in the second mode is determined to be 90 mm/s, and in a case where the measured temperature difference ΔT is equal to or larger than 80° C., the sheet conveyance speed is determined to be 60 mm/s. Further, in a case where the target temperature T1 of the heater 134 is equal to or higher than 180° C., the sheet conveyance speed in the second mode is determined to be 90 mm/s in a case where the measured temperature difference ΔT between the thermistors 133*a* and 133*b* is less than 40° C., and determined to be 60 mm/s in a case where the measured temperature difference ΔT between the thermistors 133*a* and 133*b* is equal to or larger than 40° C.

When the heat capacity in a case where the second mode is executed is referred to as a third quantity (for example 170° C.), in a case where the heat capacity is a fourth quantity (for example 135° C.) which is smaller than the third quantity, the sheet conveyance speed becomes the first value. On the other hand, in a case where the heat capacity is the third quantity and the measured temperature difference ΔT is a fifth temperature difference which is larger than the third temperature difference, the sheet conveyance speed becomes the second value. Further, in a case where the heat capacity is a fifth quantity (for example 160° C.), which is larger than the fourth quantity and smaller than the third quantity, and the measured temperature difference ΔT is the fifth temperature difference, the sheet conveyance speed becomes the second value. Further, in a case where the heat capacity is a fifth quantity, which is larger than the fourth quantity and smaller than the third quantity, and the measured temperature difference ΔT is a sixth temperature difference (for example 60° C.), which is larger than the third temperature difference and smaller than the fifth temperature difference, the sheet conveyance speed becomes the first value. At this point, the second speed in a case where the heat capacity of the sheet transferred with the toner image is the fourth quantity, which is smaller than the third quantity, is referred to as the first value. At this time, in this embodiment, depending on whether the heat capacity is the fifth quantity which is larger than the fourth quantity or whether the measured temperature difference ΔT is the fifth temperature difference which is larger than the third temperature difference, the extent of the deceleration of the second speed becomes the second value which is larger than the first value. As described above, based on the measured temperature difference ΔT between the thermistors 133*a* and 133*b* and the heat capacity of the sheet, the sheet conveyance speed is determined at the step S807. Then, in a case where the deceleration of the sheet conveyance speed is executed (YES at step S808) as the result of the step S807, the deceleration processing is performed to switch the sheet conveyance speed to V2 (step S809). Since the processing after the step S809 is the same as the first embodiment, descriptions are omitted herein.

As described above, in this embodiment, the sheet conveyance speed at the execution of the deceleration processing is determined based on the target temperature T1 of the heater 134 at the fixing processing and the temperatures of the nip portion N detected with the thermistors 133*a* and 133*b*. Therefore, in this embodiment, whether or not the deceleration processing is executed and how much extent the sheet conveyance speed is decelerated are determined based on the temperature of the nip portion N of the fixing device 130 after the printing on the front surface. Herewith, in this embodiment, by reflecting an actual condition of the nip portion N at the printing on the front surface, the decrease in the productivity at the printing on the back surface is further lessened, and it is possible to suppress the excessive temperature rise at the nip portion N of the fixing device 130.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-128951, filed on Jul. 11, 2019, which is hereby incorporated by reference herein in its entirety.

What is claimed is:

1. An image forming apparatus comprising:

an image bearing member configured to bear a toner image;

a transfer member configured to transfer the toner image borne on the image bearing member to a sheet;

a fixing unit comprising a rotary member pair configured to form a nip portion and a heating element configured to generate a heat by being supplied with power to heat the nip portion, and configured to fix the toner image on the sheet by heating the toner image transferred to the sheet at the nip portion;

a reverse conveyance unit configured to reverse the sheet which has passed through the nip portion, and resume to convey the sheet toward the transfer member;

a drive unit configured to drive the reverse conveyance unit; and a controller configured to control the drive unit and the heating element to execute a first mode and a second mode, the first mode being a mode in which the sheet is conveyed through a predetermined conveyance section in a duplex image formation by taking a first time length, the conveyance section being a section from a point at which the sheet transferred with a first toner image on a first surface of the sheet has passed through the nip portion to a point at which the sheet passed through the nip portion arrives at the nip portion again after reversed by the reverse conveyance unit and transferred with a second toner image to a second surface of the sheet by the transfer member, the second mode being a mode in which the sheet is conveyed through the conveyance section in the duplex image formation by taking a second time length longer than the first time length, wherein in the second mode, the controller is configured to execute a temperature decrease processing and thereafter execute a temperature increase processing in a period in which the sheet is conveyed through the conveyance section, the temperature decrease processing being a processing to change a target temperature of the heating element from a first temperature to a second temperature, the temperature increase processing being a processing to change the target temperature of the heating element from the second temperature to the first temperature, the first temperature being a temperature to fix the first and second toner images on the sheet, the second temperature being lower than the first temperature.

2. The image forming apparatus according to claim 1, wherein in the period in which the sheet is conveyed through the conveyance section in the second mode, the controller is configured to execute a deceleration processing to change a sheet conveyance speed of the sheet from a first speed to a second speed, which is smaller than the first speed, and thereafter execute an acceleration processing to change the sheet conveyance speed from the second speed to the first speed.

3. The image forming apparatus according to claim 2, wherein the controller is configured to execute the deceleration processing such that the reverse conveyance unit conveys the sheet at the first speed before reversing a moving direction of the sheet and conveys the sheet at the second speed after reversing the moving direction of the sheet.

4. The image forming apparatus according to claim 2, further comprising a first detection unit configured to change an output signal in accordance with presence and absence of the sheet at a first detection position between a junction, at which a transfer conveyance path and a duplex conveyance path are joined, and the transfer member, wherein the transfer conveyance path is a conveyance path on which a transfer portion, which is formed between the image bearing member and the transfer member, and the nip portion of the fixing unit are disposed, wherein the duplex conveyance path is a conveyance path which is branched from the transfer conveyance path at a position downstream of the nip portion of the fixing unit in a sheet conveyance direction on the transfer conveyance path and joined to the transfer conveyance path at a position upstream of the transfer member in the sheet conveyance direction on the transfer conveyance path, and wherein the controller is configured to execute the acceleration processing based on a detection result of the first detection unit indicating that a leading edge of the sheet delivered from the duplex conveyance path to the transfer conveyance path has passed through the first detection position.

5. The image forming apparatus according to claim 4, further comprising a second detection unit configured to change an output signal in accordance with presence and absence of the sheet at a second detection position between the fixing unit and the reverse conveyance unit, wherein in the second mode the controller is configured to execute the temperature decrease processing based on a detection result of the second detection unit indicating that a trailing edge of the sheet on the transfer conveyance path has passed through the second detection position, and execute the temperature increase processing based on the detection result of the second detection unit indicating that the leading edge of the sheet delivered from the duplex conveyance path to the transfer conveyance path has passed through the first detection position.

6. The image forming apparatus according to claim 2, wherein the controller is configured to control the drive unit to convey the sheet at the first speed during a period when the sheet is passing through the nip portion both in the first mode and in the second mode.

7. The image forming apparatus according to claim 1, wherein the controller is configured to execute the first mode in a case where a sheet width of the sheet is a first width, and execute the second mode in a case where the sheet width of the sheet is a second width which is shorter than the first width, the sheet width of the sheet being a length of the sheet in a width direction perpendicularly intersecting with a sheet conveyance direction.

8. The image forming apparatus according to claim 2, wherein the controller is configured to execute the first mode in a case where a sheet width is a first width, and execute the second mode in a case where the sheet width is a second width which is shorter than the first width, the sheet width of the sheet being a length of the sheet in a width direction perpendicularly intersecting with a sheet conveyance direction, and wherein in the second mode, the second speed is determined based on the sheet width and a sheet length of the sheet which is a length of the sheet in the sheet conveyance direction.

9. The image forming apparatus according to claim 8, wherein the controller is configured to determine the second speed to be a first value in a case where the sheet length is a first length, a second value which is smaller than the first value in a case where the sheet length is a second length which is longer than the first length, the second value in a case where the sheet length is a third length, which is longer than the first length and shorter than the second length, and the sheet width is a third width, which is shorter than the first width, and the first value in a case where the sheet length is the third length and the sheet width is a fourth width, which is smaller than the first width and larger than the third width.

10. The image forming apparatus according to claim 2, wherein the heating element is configured to heat the nip portion over a whole length thereof in a width direction perpendicularly intersecting with a sheet conveyance direction, wherein the image forming apparatus further comprises:

a first temperature measurement unit configured to measure a temperature at a center portion of the nip portion in the width direction; and a second temperature measurement unit disposed with a space from the first temperature measurement unit in the width direction and configured to measure a temperature at an edge portion of the nip portion in the width direction, wherein the controller is configured to execute the first mode in a case where a measured temperature difference is a first temperature difference, and execute the second mode in a case where the measured temperature difference is a second temperature difference, the measured temperature difference being a temperature difference between a measured temperature of the first temperature measurement unit and a measured temperature of the second temperature measurement unit.

11. The image forming apparatus according to claim 10, wherein the controller is configured to execute the first mode in a case where the measured temperature difference is a third temperature difference and a heat capacity of the sheet transferred with a toner image is a first quantity, the controller is configured to execute the first mode, and the second mode in a case where (i) the measured temperature difference is a fourth temperature difference larger than the third temperature difference, and/or (ii) the heat capacity is a second quantity is larger than the first quantity, and wherein the second speed in the second mode being determined based on the measured temperature difference and the heat capacity.

12. The image forming apparatus according to claim 11, wherein the controller is configured to determine the second speed to be a first value in case where the heat capacity is a fourth quantity which is smaller than a third quantity, a second value smaller than the first value in a case where the heat capacity is the third quantity and the measured temperature difference is a fifth temperature difference which is larger than the third temperature difference, the second value in a case where the heat capacity is a fifth quantity, which is larger than the fourth quantity and smaller than the third quantity, and the measured temperature difference is the fifth temperature difference, and the first value in a case where the heat capacity is the fifth quantity and the measured temperature difference is a sixth temperature difference which is smaller than the fifth temperature difference.

13. The image forming apparatus according to claim 1, further comprising:

a feeding member configured to feed the sheet;

a conveyance member configured to convey the sheet fed by the feeding member; and a duplex conveyance unit configured to convey the sheet reversed by the reverse conveyance unit toward the transfer member, wherein the drive unit is a single motor which is configured to drive the feeding member, the conveyance member, the transfer member, the rotary member pair, the reverse conveyance unit, and the reverse conveyance unit.

* * * * *